US008746837B2

(12) United States Patent
Inada et al.

(10) Patent No.: US 8,746,837 B2
(45) Date of Patent: Jun. 10, 2014

(54) LIQUID EJECTION HEAD AND LIQUID EJECTION APPARATUS

(75) Inventors: Genji Inada, Koshigaya (JP); Kiyomitsu Kudo, Machida (JP); Tomotsugu Kuroda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 13/219,411

(22) Filed: Aug. 26, 2011

(65) Prior Publication Data

US 2012/0050389 A1 Mar. 1, 2012

(30) Foreign Application Priority Data

Aug. 30, 2010 (JP) ..... 2010-192398
Jul. 25, 2011 (JP) ..... 2011-161871

(51) Int. Cl.
*B41J 2/015* (2006.01)

(52) U.S. Cl.
USPC ..... 347/20

(58) Field of Classification Search
USPC ..... 347/20, 87
See application file for complete search history.

(56) References Cited

U.S. PATENT DOCUMENTS

| | | | | |
|---|---|---|---|---|
| 6,364,458 | B2 * | 4/2002 | Eckard et al. | 347/49 |
| 7,321,739 | B1 * | 1/2008 | Dawson et al. | 399/90 |
| 2002/0139809 | A1 * | 10/2002 | Barry et al. | 220/762 |
| 2004/0196333 | A1 * | 10/2004 | Yoshiyama et al. | 347/49 |
| 2007/0236548 | A1 * | 10/2007 | Ohira | 347/86 |

FOREIGN PATENT DOCUMENTS

JP 2000-203040 A 7/2000

* cited by examiner

*Primary Examiner* — Julian Huffman
*Assistant Examiner* — Sharon A Polk
(74) *Attorney, Agent, or Firm* — Canon USA Inc IP Division

(57) ABSTRACT

A liquid ejection head includes a head body configured to eject liquid, a holding portion rotatable with respect to the head body about a rotation shaft provided on the head body and configured to support the head body, and a rotation regulation portion configured to regulate the rotation of the holding portion with respect to the head body beyond an arrangement in which the holding portion, the rotation shaft, and a center of gravity of the head body aligned in a line in a direction of gravity with the head body held by the holding portion.

8 Claims, 6 Drawing Sheets

LIQUID EJECTION HEAD AND LIQUID EJECTION APPARATUS

BACKGROUND OF THE INVENTION

1. Field of the Invention

The present invention relates to a liquid ejection head configured to eject liquid and a liquid ejection apparatus.

2. Description of the Related Art

An inkjet head (liquid ejection head) which is detachably attachable to a carriage (mounting portion) is needed to be fixed to the carriage with a high degree of accuracy. Accordingly, accuracy of the flying directions of liquid droplets with respect to the plane of the paper is improved, and hence good printing quality can be maintained.

In order to allow easy holding of the inkjet head when mounting the inkjet head to the carriage, there is a case where a handle (holding member) is provided on the top of a head. In Japanese Patent Laid-Open No. 2000-203040 (FIG. 7), a configuration in which a handle (holding member) is provided on the top of the inkjet head is described.

When the handle is provided on the inkjet head so that a grip (holding portion), as a portion of the handle, to be held rotates about a rotation shaft of the handle, the inkjet head can be carried easily. However, when the inkjet head is held in midair by an operator holding the grip, the inkjet head rotates freely about the rotation shaft. Therefore, the posture or position of the inkjet head is not stabilized when mounting the inkjet head to the carriage, mounting of the inkjet head on the carriage becomes difficult. Also, depending on the posture of the inkjet head, a component in the carriage and a face surface (ejection surface) of the inkjet head provided with ejection orifices are in danger of contacting each other at the time of mounting.

SUMMARY OF THE INVENTION

Accordingly, the present disclosure provides a liquid ejection had having a holding member having a holding portion which is rotatable about the rotation shaft in which the posture of a liquid ejection head is stabilized at the time of mounting the same on a mounting portion to facilitate the mounting of the liquid ejection head on the mounting portion. The present invention is also intended to reduce the risk of contact of an ejection surface of the liquid ejection head against the interior of the mounting portion at the time of being mounted on the mounting portion.

According to an aspect of the invention, a liquid ejection head includes: a head body configured to eject liquid, a holding portion rotatable with respect to the head body about a rotation shaft provided on the head body and configured to support the head body, and a rotation regulation portion configured to regulate the rotation of the holding portion with respect to the head body beyond an arrangement in which the holding portion, the rotation shaft, and a center of gravity of the head body are aligned in a line in the direction of gravity with the head body held by the holding portion.

According to the aspect of the invention, the posture of the liquid ejection head at the time of being mounted on the mounting portion can be stabilized to facilitate the mounting of the liquid ejection head on the mounting portion. It is also possible to reduce the risk of contact of the ejection surface of the liquid ejection head against the interior of the mounting portion at the time of being mounted on the mounting portion.

Further features of the present invention will become apparent from the following description of exemplary embodiments with reference to the attached drawings.

DESCRIPTION OF THE EMBODIMENTS

Figure 1A:
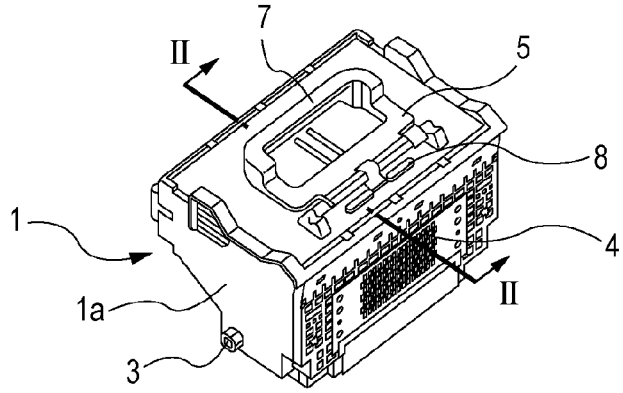
FIGS. 1A to 1D illustrate an inkjet head according to an embodiment disclosed herein.
Figure 1B:
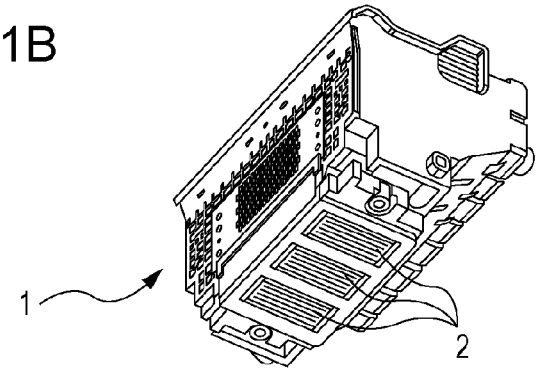
Figure 1C:
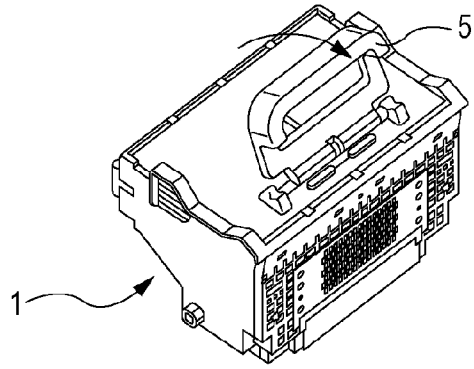

Referring now to the drawing, embodiments to which the invention can be applied will be described.

Figure 1D:
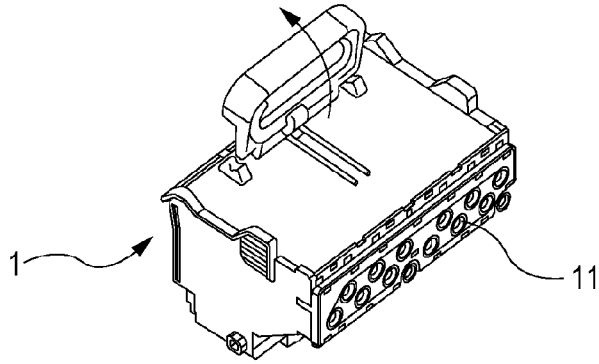

FIGS. 1A to 1D show an inkjet head 1 as a liquid ejection head according to the embodiment. The inkjet head 1 includes a printed wiring board 4 electrically connected to an electric contact substrate 15 (See FIG. 5A) on a carriage 12 (mounting portion) provided on an inkjet printer (liquid ejection apparatus) and face surfaces 2 (ejection surfaces) that eject liquid droplets. A set of rough guides 3 (guiding members) are provided on two side surfaces of the inkjet head 1 facing each other in a scanned direction (primary scanning direction). The rough guides 3 are projections that project and extend from side surfaces of a head body 1*a*, and the rough guide 3 on one of the side surfaces is provided on an extension line of the rough guides 3 on the other side surface in the direction of projection thereof. The printed wiring board 4 has a plurality of joint portions 11 that allow connection of supply tubes 16 configured to supply ink to the inkjet head 1 on the carriage 12 from an ink tank placed in the inkjet printer on an opposite side surface (FIG. 1D).

The rough guides 3 engage guide groove bevels 14 (inclined portion, See FIG. 5B) of guide groove 13 (See FIG. 6) provided on the carriage 12 when mounting the inkjet head 1 to the carriage 12, and guide the inkjet head 1 to a position near a predetermined mounting position on the carriage 12 along the guide groove bevels 14. The direction of the guide groove bevels 14 corresponds to the mounting direction of the inkjet head 1.

The head body 1*a* is provided with a handle 5 (holding member) on an upper surface thereof, and a grip 7 (holding portion) of the handle 5 serves as a portion to be held of the inkjet head 1. The handle 5 is rotatable about the center of a rotation shaft 6 (See FIG. 2A) provided on the upper surface of the inkjet head 1 with respect to the head body 1*a*. In the embodiment, the handle 5 is rotatable about an axis extending substantially parallel to the primary scanning direction as indicated by arrows in FIGS. 1C and 1D (i.e., the axis established by the curl of the arrow either in FIG. 1C or FIG. 1D, and substantially parallel to the rotation shaft 6). The head body 1*a* is a portion of the inkjet head 1 except for the handle 5.

When mounting the inkjet head 1 on the carriage 12, an operator or a user raises the handle 5 and holds the inkjet head 1. On the carriage 12, the handle 5 does not rotate with respect to the head top surface as shown in FIG. 1A, and takes a posture (i.e., a position) along the head top surface. A carriage rotation stopper 8 (rotation regulation portion) regulates the rotatable angle of the handle 5.

Figure 2A:
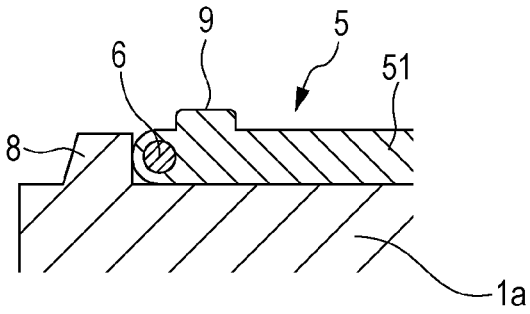
FIGS. 2A and 2B are drawings illustrating a configuration of a part in the vicinity of a rotation shaft of a handle of an inkjet head in the embodiment.
Figure 2B:
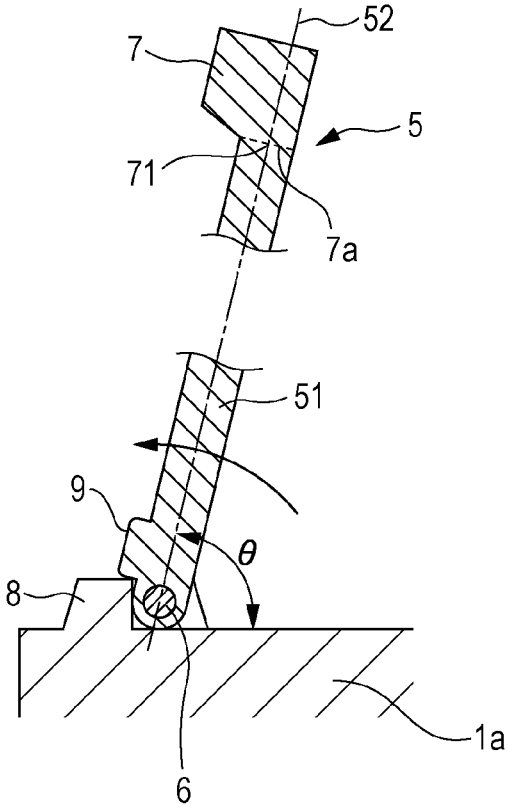

FIGS. 2A and 2B are partial cross-sectional views of the line II-II (FIG. 1A) in the vicinity of the rotation shaft 6 of the handle 5. Provided at a root portion of the handle 5, that is, in the vicinity of the rotation shaft 6 is a protrusion 9, so that the protrusion 9 comes into contact with the rotation stopper 8 when the handle 5 is rotated by an angle θ with respect to the upper surface of the head body 1*a* counterclockwise in the drawing. Accordingly, the rotation of the handle 5 is regulated (FIG. 2B). The angle θ can be set according to the shapes of the rotation stopper 8 and the protrusion 9.

Figure 3A:
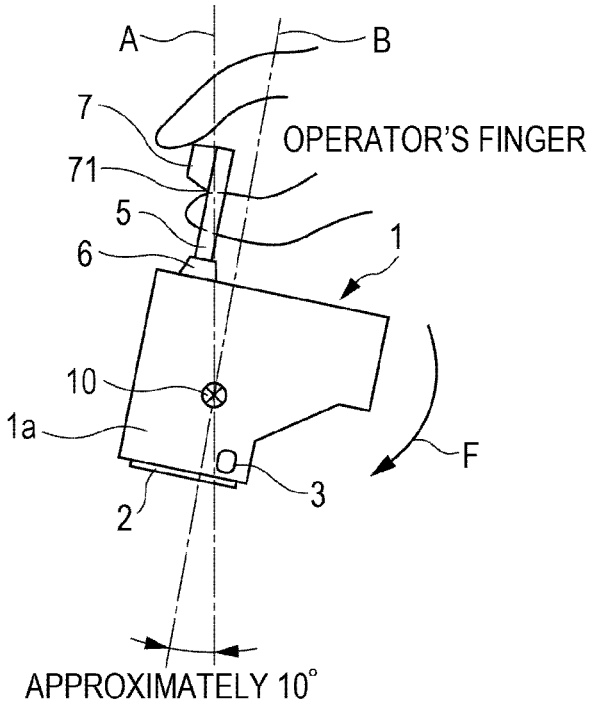
FIG. 3A is an illustration of the inkjet head in a state of being held in midair according to the embodiment.
Figure 3B:
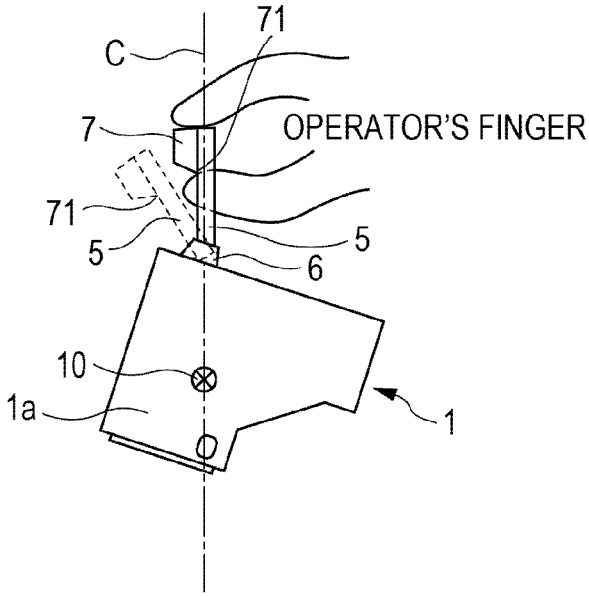
FIG. 3B is an illustration of the inkjet head in the state of being held in midair according to a comparative example.

FIG. 3A illustrates the inkjet head 1 according to the embodiment in a state of being held in midair by the operator holding the grip 7 of the handle 5. In FIGS. 3A and 3B, the downward direction in the drawing corresponds to the direction of gravity. The inclination of the head body 1*a* may be replaced by an expression "the rotation of the handle" from a different angle. When the operator holds the grip 7 and lifts the inkjet head 1, the head body 1*a* is inclined by the inkjet's dead weight (i.e., the actual weight).

FIG. 3B is a drawing corresponding to FIG. 3A according to a comparative example in which there is no rotation stopper 8 provided thereon and hence the handle 5 is rotatable through 180 degrees about the rotation shaft 6. When the head held in midair comes to rest, three parts, namely, a grip point 71, the rotation shaft 6, and a center of gravity 10 of the head body 1*a* are aligned in the direction of gravity (the downward direction in the drawings) (FIG. 3B). At this time, the grip point 71 designates an intersection between an axis 52 (indicated by a chain line in FIG. 2B) of a rod 51 of the handle 5 and a gripped surface 7*a* of the grip 7 as shown in FIG. 2B, and can be considered as a point of action of the dead weight of the head applied to a finger when the inkjet head 1 is held in midair.

As shown in FIG. 3A, in the embodiment, since the rotation of the head body 1*a* is regulated by the contact between the rotation stopper 8 (FIG. 2B) and the handle 5, the center of gravity 10 never moves beyond a line (FIG. 3B) connecting the grip point 71 and the rotation shaft 6 in the direction of rotation. In the inkjet head 1 held in midair, the direction of a line (a chain line A in FIG. 3A) connecting the grip point 71 and the center of gravity 10 corresponds to the direction along the direction of gravity. Here, the angle θ in the counterclockwise direction in FIG. 2B is determined so that the angle between the chain line A and a perpendicular (a chain line B in FIG. 3A) with respect to the face surfaces 2 of the inkjet head 1 in a normal posture, which is a usage state in which the inkjet head 1 is mounted on the carriage 12, forms an angle of approximately 10°. The angel θ in FIG. 2B is not specifically limited as long as the center of gravity 10 of the head body 1*a* does not move beyond the line connecting the grip point 71 and the rotation shaft 6 (FIG. 3B) in the direction of rotation.

In the state shown in FIG. 3A, a turning force F (i.e., a torque) around the rotation shaft 6 of the handle 5 is still applied to the inkjet head 1 in the direction indicated by an arrow in the drawing by the dead weight of the head body 1*a*. Therefore, the inclination of the head body 1*a* in midair is fixed at a position where the rotation stopper 8 and the handle 5 are in contact with each other, and the head body 1*a* does not swing about the rotation shaft 6.

Figure 6:
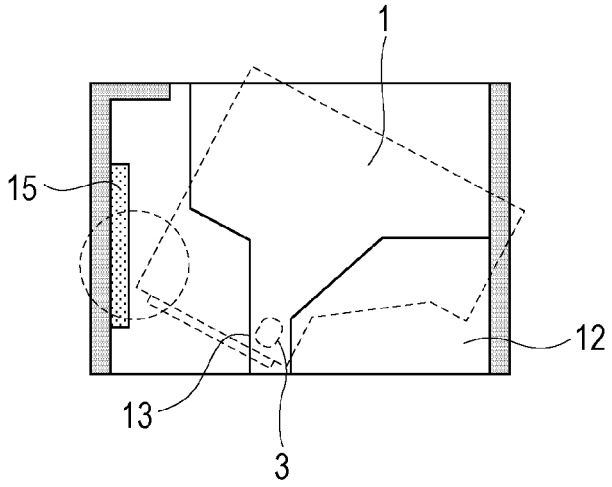
FIG. 6 illustrates an inkjet head arranged in an improper position.

In contrast, like the handle 5 indicated by a broken line shown in FIG. 3B, when the grip point 71 is allowed to rotate about the rotation shaft 6 beyond a line connecting the center of gravity 10 and the rotation shaft 6 (a chain line C), the head body 1*a* held in midair is brought into the swing of the pendulum about the rotation shaft 6 in the lateral direction in the drawing. From a different angle, the grip point 71 of the handle 5 rotates across a straight line connecting the rotation shaft 6 and the center of gravity 10 of the head body 1*a*. In this case, since the posture of the head body 1*a* is not stabilized when the grip 7 is held for mounting the inkjet head 1 on the carriage, mounting of the inkjet head 1 on the carriage 12 becomes difficult. Also, when the inkjet head 1 is mounted on the carriage 12 in a posture of being too much inclined as shown in FIG. 6, the face surfaces 2 have a risk of coming into contact with the component in the carriage 12 (the portion surrounded by a dot circle in FIG. 6). FIG. 6 shows a cross section of the carriage 12 including the guide groove 13 and a cross section of the inkjet head 1. Although the inkjet head 1 is shown partly transparently, the inkjet head 1 is indicated by a broken line entirely for the sake of easy understanding.

Accordingly, in the embodiment, the rotation stopper 8 regulates the rotation of the head body 1*a* so that the center of gravity 10 does not move beyond the line connecting the grip point 71 and the rotation shaft 6 in the direction of gravity in a state in which the inkjet head 1 is held in midair. Accordingly, when the inkjet head 1 is held in midair when being mounted on the carriage 12, a free rotation of the head body 1*a* about the rotation shaft 6 is regulated and the position of the inkjet head 1 is stabilized. Therefore, in the inkjet head 1 providing a good handling property with the handle 5, the mounting on the carriage 12 is facilitated, and the risk of contact of the face surfaces 2 with respect to the component in the carriage 12 may be reduced.

Subsequently, the mounting of the inkjet head 1 on the carriage 12 will be described.

Figure 4:
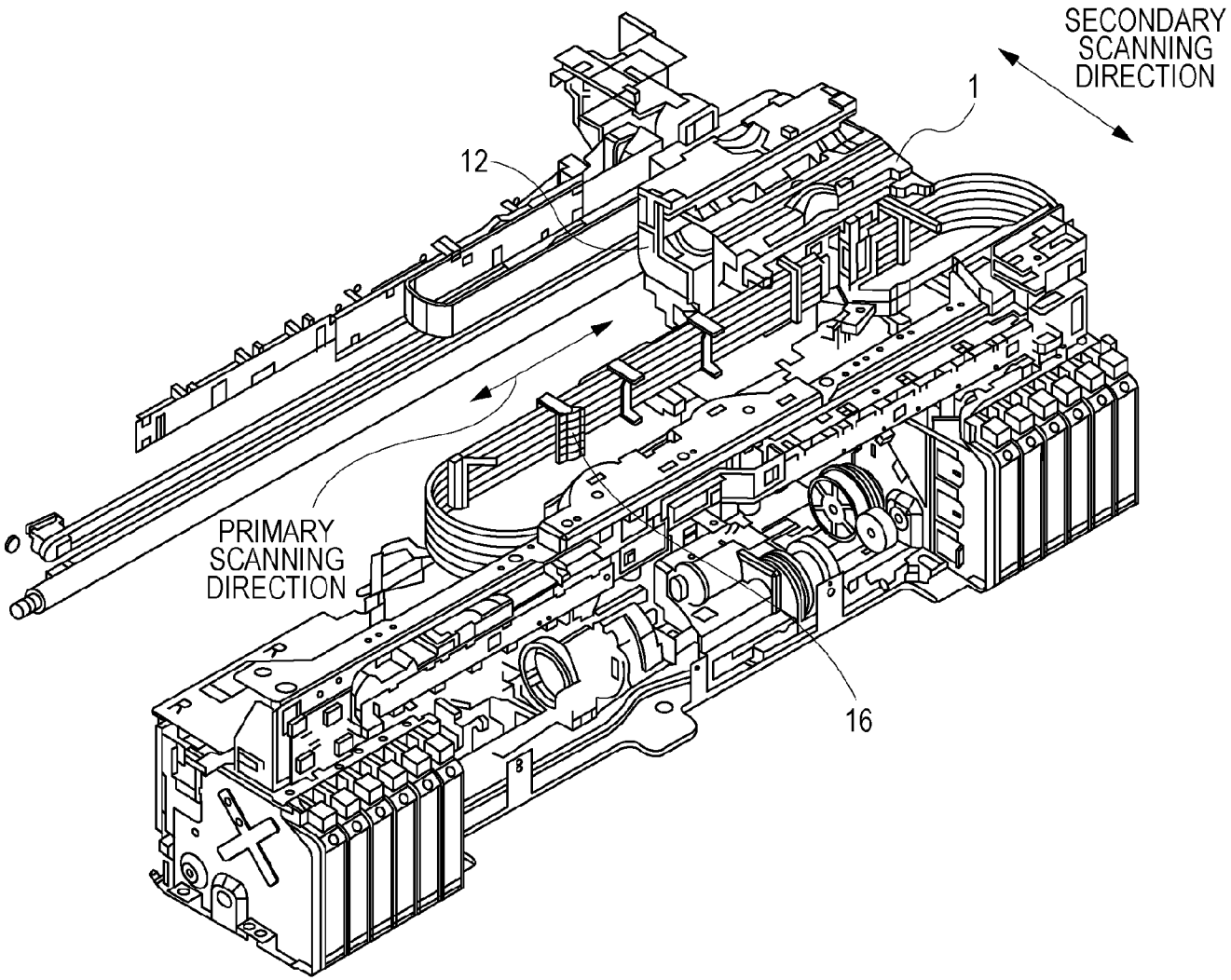
FIG. 4 is an illustration of an inkjet printer in a state in which the inkjet head is mounted on a carriage.

The inkjet head 1 is held in midair with respect to the inkjet printer by the operator holding the grip 7 of the handle 5, and is attached to the carriage 12 from above in the posture in which the inkjet head 1 is kept in substantially parallel to the primary scanning direction (FIG. 4). The inkjet head 1 is attached so that the printed wiring board 4 comes into contact with the electric contact substrate 15 and, accordingly, the inkjet head 1 and the inkjet printer are electrically connected.

FIGS. 5A to 5D are drawings for explaining the mounting of the inkjet head 1 on the carriage 12. FIGS. 5A to 5D show cross sections each including the guide groove 13 of the carriage 12 and the inkjet head 1. Although the inkjet head 1 is shown partly transparently, the inkjet head 1 is indicated by a broken line entirely for the sake of easy understanding.

Figure 5A:
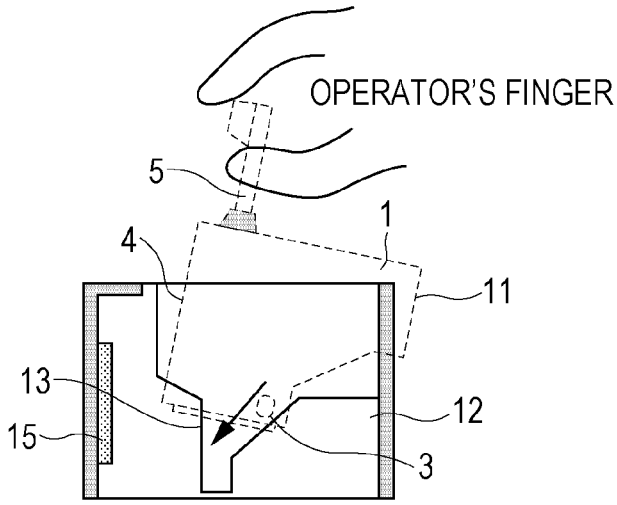
FIGS. 5A to 5D illustrate a possible sequence of mounting the inkjet head on the carriage according to the embodiment.

As described above, the inkjet head 1 held in midair is in the state in which the posture about the rotation shaft 6 is fixed by the rotation stopper 8. In this position, firstly, the rough guides 3 provided on the both side surfaces are inserted into the guide grooves 13 provided on the both side surfaces in the interior of the carriage 12 from above (FIG. 5A).

Here, as shown in FIG. 3A, the rough guides 3 are provided on the both side surface of the head body 1*a* in the vicinity of the lowermost portion of the face surfaces 2. Therefore, the inkjet head 1 can be brought toward the carriage 12 with the rough guides 3 at the forefront. Accordingly, since the face surfaces 2 of the inkjet head 1 incline upward in the drawing, about the rough guides 3 as an axis, the risk of contact of the face surfaces 2 against the interior of the carriage 12 can be reduced. In comparison with a case where the head is inserted in the normal posture, the rough guides 3 can easily be inserted along the guide grooves 13.

Figure 5B:
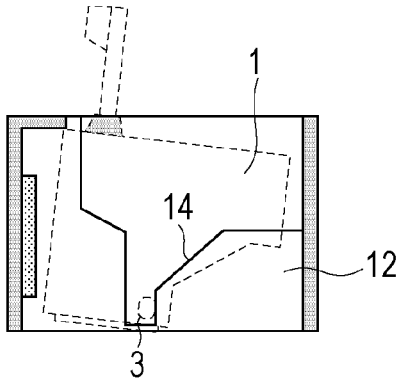

The rough guides 3 engage the guide groove bevels 14, and guide the inkjet head 1 along the bevels. Here, an arrow shown in FIG. 5A indicates the mounting direction of the inkjet head 1 with respect to the carriage 12. Then, the inkjet head 1 is provisionally placed on the carriage 12 so that the rough guides 3 are positioned within lower portions of the guide grooves 13 (FIG. 5B). As described already, the rough guides 3 move along the guide groove bevels 14 in a state in which the head body 1*a* is held shown in FIG. 3A by the rotation stopper 8. Accordingly, the head body 1*a* is inserted in a state of being held in a constant posture with respect to the carriage 12. Accordingly, a risk of contact of the face surfaces 2 with the interior of the carriage 12 when the inkjet head 1 is inserted into the carriage 12 in an improper position as shown in FIG. 6 can be reduced.

In particular, when the ink jet head having only the rough guides 3 but not the handle 5 described above is mounted on the carriage, the position of the inkjet head with respect to the direction of rotation about the rough guides 3 as an axis is not regulated. Therefore, the axial direction of the rough guide 3, which is the direction of projection of the rough guides 3 provided on the both side surfaces of the head body 1*a*, and the direction of the rotation shaft 6 of the handle 5 can be aligned with each other.

Figure 5C:
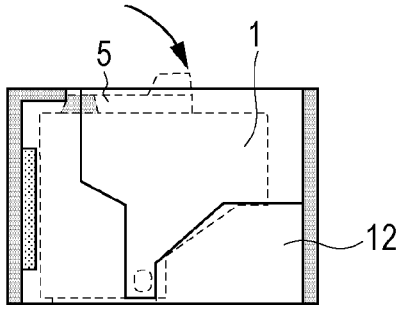
Figure 5D:
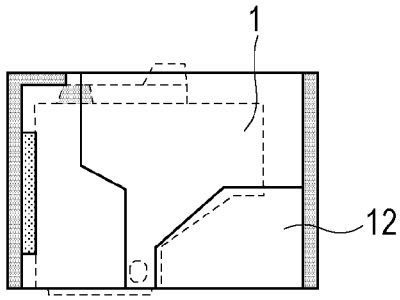

When the operator releases his or her hand from the handle 5, the inkjet head 1 rotates in such a manner that the center of gravity 10 is moved downward about a portion near the rough guides 3, and takes the normal posture in a state of being provisionally placed (FIG. 5C). When the operator releases his or her hand from the handle 5, the handle 5 is returned to a position laid along the top surface of the inkjet head 1. Subsequently, the inkjet head 1 is fixed on the carriage 12 by a locking unit, not shown (FIG. 5D). With the locking unit, contact of contact portions (not shown) of the inkjet head 1 and the carriage 12 is ensured, and the relative position between the inkjet head 1 and the carriage 12 is fixed.

The printed wiring board 4 comes into contact correctly with the electric contact substrate 15. Needles at the distal end (not shown) at the ink supply tube are inserted into the joint portions 11 from the locking direction in FIG. 5D substantially horizontally. Since the relative positional relationship between the joint portions 11 and the carriage 12 is suitable, insertion of the needles at the distal end into the joint portions 11 is ensured, so that the risk of leakage of ink from the joint portions 11 is reduced.

After the fixation, the position of the inkjet head 1 with respect to the carriage 12 is also fixed correctly, and hence the flying directions of the liquid droplets with respect to a recording medium are stabilized, so that the favorable printing is achieved.

As described thus far, in the embodiment, when the inkjet head 1 is held in midair, the rotation of the handle 5 is stopped by the contact between the rotation stopper 8 and the protrusion 9 before moving beyond the arrangement of the grip point 71, the rotation shaft 6, and the center of gravity 10 aligned in a line in the direction of gravity. At this time, since the turning force F caused by the dead weight of the inkjet head 1 is still applied to the inkjet head 1, the inkjet head 1 is kept in a constant posture.

Also, since the example in which the inkjet head 1 has a set of the rough guides 3 has been described, the rough guides 3 may not be provided for the purpose of holding the inkjet head 1 in the constant posture in a state of being held in midair. In other words, by regulating the inclination of the inkjet head 1 at the time of being inserted into the carriage 12 by the rotation stopper 8, the risk of contact of the face surfaces 2 with respect to the interior of the carriage 12 may be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-192398 filed Aug. 30, 2010 and No. 2011-161871 filed Jul. 25, 2011, which are hereby incorporated by reference herein in their entirety.

What is claimed is:

1. A liquid ejection head comprising:

a head body configured to eject liquid;

a holding portion rotatable with respect to the head body about a rotation shaft provided on the head body and configured to support the head body; and a rotation regulation portion configured to stop the rotation of the holding portion with respect to the head body before an arrangement in which the holding portion, the rotation shaft, and a center of gravity of the head body are aligned in a line in a direction of gravity with the head body held by the holding portion.

2. The liquid ejection head according to claim 1, wherein the head body is held by the holding portion, and the head body is mounted on a mounting portion in a state in which an ejection surface provided on the head body and configured to eject liquid faces downward with respect to the direction of gravity.

3. The liquid ejection head according to claim 2, wherein by engagement between a guiding member provided on the head body and an inclined portion provided on the mounting portion, the mounting direction of the head body with respect to the mounting portion is regulated.

4. The liquid ejection head according to claim 3, wherein the guiding member is provided respectively on opposed side surfaces of the head body, and an axis connecting the guiding member provided respectively on the opposed side surfaces extends along the rotation shaft.

5. The liquid ejection head according to claim 4, wherein in a state in which the head body is held by the holding portion, the rotation of the holding portion with respect to the head body is stopped by the rotation regulation portion so that the ejection surface is inclined in the direction of rotation about the rotation shaft more than in a state in which the head body is mounted on the mounting portion.

6. The liquid ejection head according to claim 5, wherein the guiding member provided on the head body is located on the opposed side surfaces in the vicinity of the lowermost portion of the ejection surface in the direction of gravity in a state in which the head body is held in the holding portion.

7. A liquid ejection apparatus configured to eject liquid comprising:

the liquid ejection head according to claim 1; and a mounting portion to which the head body is mounted.

8. The liquid ejection head according to claim 1, wherein the holding portion includes a rod rotatable with respect to the head body, and a protrusion protruding from the rod that comes into contact with the rotation regulation portion protruding from the head body so as to stop the rotation of the holding portion with respect to the head body.

* * * * *